United States Patent [19]

Terui

[11] 4,433,504

[45] Feb. 28, 1984

[54] CONTAINER AND START APPARATUS FOR TOY CARS

[75] Inventor: Masumi Terui, Matsudoshi, Japan

[73] Assignee: Takara Co., Ltd., Tokyo, Japan

[21] Appl. No.: 381,364

[22] Filed: May 24, 1982

[30] Foreign Application Priority Data

May 27, 1981 [JP] Japan ..... 56-75762[U]

[51] Int. Cl.[3] ..... A63H 33/00

[52] U.S. Cl. ..... 46/11; 46/202

[58] Field of Search ..... 46/202, 11, 1 K, 12, 46/32, 206, 201

[56] References Cited

U.S. PATENT DOCUMENTS 3,621,607 11/1971 Morrison et al. ..... 46/116
3,731,420 5/1973 Crosman ..... 46/11 X
3,886,682 6/1975 Ieda et al. ..... 46/202
4,192,093 3/1980 Hamano ..... 46/206 X
4,285,157 8/1981 Lambert ..... 46/202
4,349,983 9/1982 Kilroy et al. ..... 46/11 X

FOREIGN PATENT DOCUMENTS 430722 6/1926 Fed. Rep. of Germany ..... 46/202

*Primary Examiner*—MIckey Yu
*Attorney, Agent, or Firm*—Jackson, Jones & Price

[57] ABSTRACT

A combination storage container and launching apparatus for self-propelled toy miniature vehicles includes a base member capable of supporting a miniature vehicle for storage and wall members that can be pivotally connected to the base member. The wall members further provide structures for restraining a miniature vehicle when positioned in a horizontal operative mode, and pivotal levers for releasing the miniature vehicle to permit self propulsion.

17 Claims, 4 Drawing Figures

CONTAINER AND START APPARATUS FOR TOY CARS

BACKGROUND OF THE INVENTION

1. Field of the Invention

The present invention is an accessory for toy cars and more particularly a storage container and starting gate apparatus for spring-powered toy vehicles.

2. Description of the Prior Art

Recently the toy industry has provided a large number of miniature toy vehicles for the play action enjoyment of children. One form of particularly pleasing toy vehicles has been sold under the trademark Penny Racers and comprises a series of different toy vehicle designs of approximately 1 inch in width by 1½ inches in length that are driven by a miniature spring-wound prime mover.

The prior art has proposed various structures for launching self-propelled toy vehicles, such as disclosed in U.S. Pat. No. 3,621,607, U.S. Pat. No. 3,701,216 and U.S. Pat. No. 3,886,682.

The prior art has additionally disclosed various forms of toys that can be reconfigured into a storage container wherein the walls of the storage container are capable of being folded out to provide various forms of play action, such as disclosed in U.S. Pat. No. 4,090,321. All of the above toys represented in these patents may have provided enjoyment to a child but the imagination and short attention span of a child continually requires new and novel toys to maintain their interest. Accordingly, the toy industry is still looking for novel forms of toys to serve this purpose.

SUMMARY OF THE INVENTION

The present invention provides a combination storage container and launching or starting gate apparatus for self-propelled four-wheeled miniature vehicles. A base member has a central supporting surface for toy vehicles with a pair of end vertical walls that can be interconnected by a central support member extending above the support surface. A pair of side wall members can be pivotally connected to the base member, and are preferably molded to provide ramp members terminating in retaining ledges, a mounting means is also molded on the side wall member to retain a pivotal lever member capable of actuating the launching of a miniature vehicle with pre-stored energy. The miniature vehicle can be of a spring-wound type and the ramp member can include a retaining ledge that permits the front wheels of a miniature vehicle to be positioned on the ramp member while the driven rear wheels will be restrained by the retaining ledge member. The pivotal lever member is capable of elevating the rear wheels to approximately the height of the ramp member wherein the miniature vehicle is then released for self propulsion. The side wall members can have an exterior L-shaped configuration that is capable of coacting with the support surface, the pair of end walls and the central support member to form a closed storage container configuration. Handles can be provided at the edge of each of the side walls to facilitate carrying by a child.

The features of the present invention, which are believed to be novel, are set forth with particularity in the appended claims. The present invention, both as to its organization and manner of operation, together with objects and advantages thereof, may best be understood by reference to the following description, taking into conjunction with the accompanying drawings.

DESCRIPTION OF THE PREFERRED EMBODIMENT

A description of the preferred embodiment is provided to enable any person skilled in the toy industry to make and use the invention. The best mode contemplated by the inventor in carrying out his invention is disclosed, however, various modifications will remain readily apparent to those skilled in the art since the generic principles of the present invention have been defined herein specifically to provide a relatively inexpensive miniature toy car storage and launching apparatus.

Figure 1:
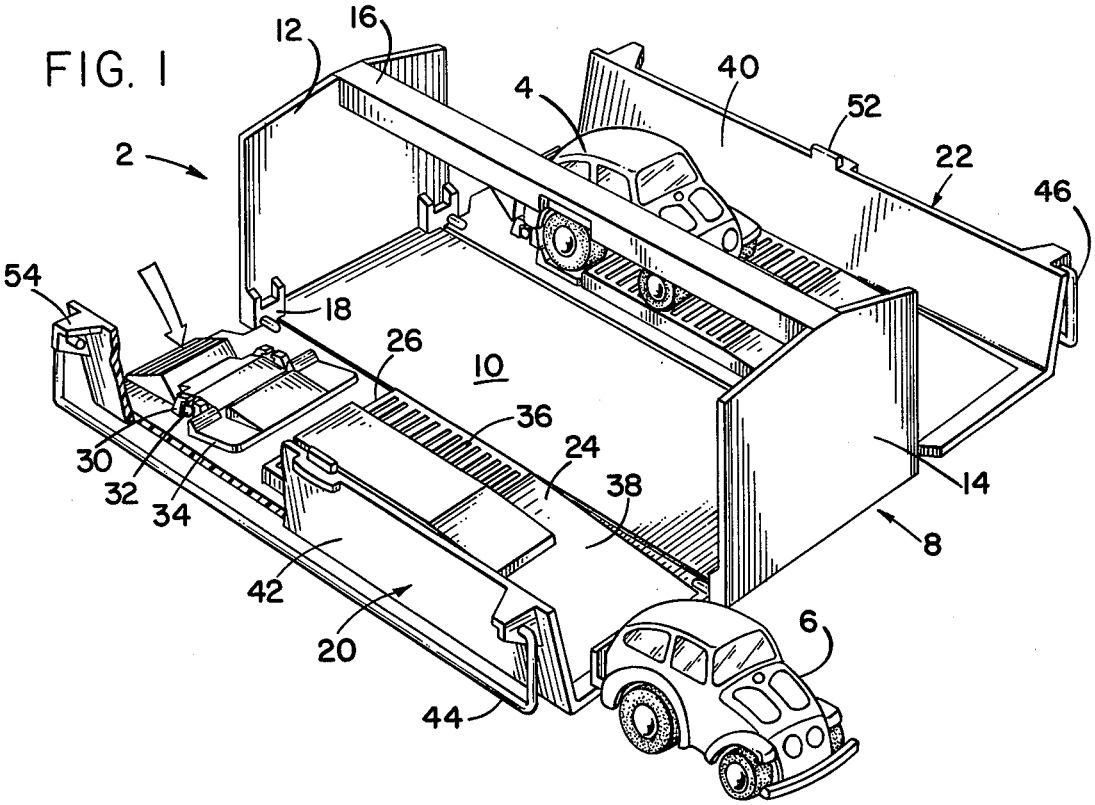
FIG. 1 is an elevated perspective view of the present invention with a portion of a side wall removed to clarify the view.

Referring to FIG. 1, the combination storage container and launching apparatus 2 is disclosed in a perspective view with a pair of miniature toy vehicles 4 and 6. In this view the vehicle 4 is retained in a stationary position while the vehicle 6 has just been released so that it is being launched from the storage container apparatus 2. As can be readily appreciated, the apparatus 2 can function as a starting gate for initiating a race between the two vehicles.

In the preferred embodiment, three basic component parts can be appropriately molded from plastic to basically form the structure of the storage container 2. Various design features or indicia can be subjectively molded into the parts, e.g., to create an impression of a garage structure. The first component is a base member 8 having a horizontal support surface 10 terminating respectively at each of its longitudinal ends with a first end wall 12 and a second wall 14. Interconnecting the respective end walls is a central support member 16 that extends above the support surface 10. Appropriate mounting blocks 18 having mounting bores (not shown) are positioned at each of the corners of the support surface 10.

Pivotably connected to the mounting blocks 18 of the base member 8 are side wall members 20 and 22. Each side wall member has an integrally mounted ramp member 24 which terminates in a retaining ledge 26. The dimensions of the ramp member 24 and retaining ledge 26 are sufficient so that the front wheels of a miniature vehicle having pre-stored energy are supported on the ramp member 24 while the rear wheels are constrained by the retaining ledge 26. The miniature vehicles 4 and 6 can be of the type having a spring-wound motor and gear transmission which is capable of retaining spring energy by the reverse movement of the rear wheels and then releasing the same energy through a gear transmission that is connected by a different ratio to the rear axle for driving the rear wheels. Retaining ledge 26, however, is of such a dimension and configuration that it is capable of holding the rear wheels in a stationary position even when the maximum spring energy has been stored.

A pivotal lever member 28 is mounted within respective retainer pins 30 that are integrally molded in each side wall member. The configuration of the pivotal lever member 28 and the position of the retainer pins 30 for interaction with side posts 32 of the lever member 28 are such to position a release plate 34, designed to support and elevate the rear wheels of the miniature vehicles, adjacent the retainer ledge 26.

A serrated track portion 36 of the ramp member 24 substantially covers the horizontal portion of the ramp member to provide an improved traction of the rear wheels when the vehicle is suddenly released. The ramp member 24 further includes an inclined surface 28 to facilitate the launching of the miniature vehicle from the storage container 2.

Figure 4:
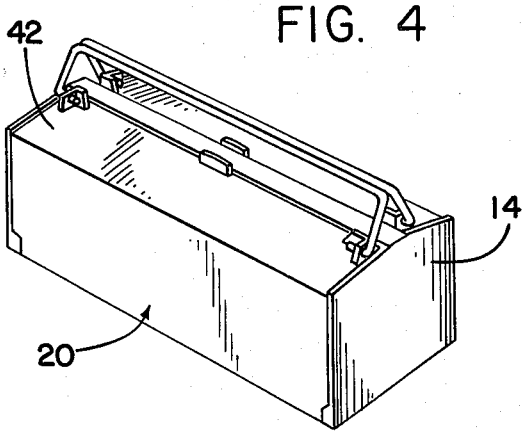
FIG. 4 is a perspective view of the present invention in a storage container mode of operation.

Each of the side wall members 20 and 22 have a substantially L-shaped exterior configuration resulting from the position of rail members 40 and 42 mounted on the outside edge adjacent each ramp member. These rail members 40 and 42 become upper top or roof sections when the storage container is closed as shown in FIG. 4. Handle members 44 and 46 are respectively pivotally mounted on the side wall members 20 and 22.

Figure 2:
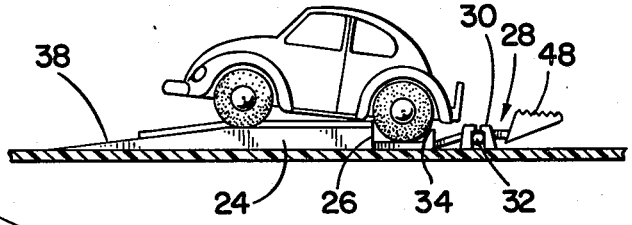
FIG. 2 is a side view partially in cross-section of a side wall.
Figure 3:
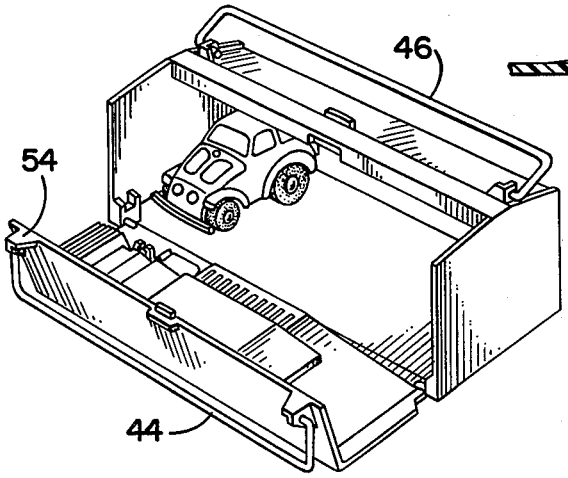
FIG. 3 is a perspective view of the present invention with a vehicle in one storage position.

Referring to FIG. 2, the pivotal lever member 28 is disclosed with the miniature toy vehicle in a stationary position after a portion of the side wall member has been rotated approximately from a traverse position relative to the base member 8 to a position approximately parallel to the base member 8. A rear serrated pressure member 48 can be subjectively manipulated by a child operator for elevating the rear wheels of the miniature vehicle to approximately the height of the ramp member whereby the self-propelled miniature vehicle is released. As seen in FIG. 3, the vehicles can be stored in the container configuration. The particular orientation of the car, whether extending traverse to the longitudinal axis, of the base member 8 or parallel with the longitudinal axis depends upon the particular width of the support surface 10. In one preferred embodiment the support surface 10 is only sufficiently wide enough to permit a pair of miniature toy vehicles to be stored in a position aligned with the longitudinal axis of the base member 8.

Finally, as seen in FIG. 4, the storage container 2 with the respective side wall members 20 and 22 folded into a close configuration can be easily transported by a child holding on to the handle members 44 and 46. An appropriate locking apparatus which comprises a notch portion 50 on either side of the support member 16 is dimensioned to coact with respective locking tabs 52 to provide a friction fitting lock for each of the respective side wall members.

In essence, the present invention can be manufactured from seven separate parts. The three major or basic components are the base member 8 and the respective side wall members 20 and 22. The lever members 28 can be snapped into retainer pins 30 on each of the side wall members. Finally, the handle members 46, which can be made of steel wire, can be mounted within appropriate mounting posts 54.

The child operator can store spring energy in each of the respective toy vehicles and mount them in the respective side wall members 20 and 22 when they have been rotated to an operative horizontal position. As can be readily appreciated the child or children can individually release the toy vehicles by activation of the respective pivotal lever members 28 and can, in effect, have a race between the two vehicles by releasing them from their launching position. The serrated track portions 36 of the ramp member 24 assist in preventing slippage of the rear wheels upon their initial release. When the child is finished playing with the vehicles he can then position them on the supporting surface 10 and rotate the respective side wall members to essentially a vertical position with a friction fitting of locking tabs 52 and notch portions 50 so that the storage container 2 takes the configuration shown in FIG. 4.

As can be readily appreciated, it is possible to deviate from the above embodiment of the present invention, and it will be readily understood by those skilled in the toy industry that the invention is capable of many modification improvements within the scope and spirit thereof. Accordingly, it will be understood that the invention is not to be limited by the specific disclosed embodiment, but only by the scope and spirit of the appended claims.

What is claimed:

1. A combination storage container and launching apparatus for self propelled miniature vehicles comprising:

a base member capable of supporting a miniature vehicle for storage;

at least one wall member movably connected to the base member from a first storage position wherein at least a portion of the wall member is traverse to the base member to a second launching position, wherein that portion of the wall member is approximately parallel to the base member;

means on the wall member for supporting and restraining a miniature vehicle, capable of self propulsion, in a stationary position, when the wall member is positioned approximately parallel to the base member, and means on the wall member for releasing the miniature vehicle to permit propulsion of the vehicle.

2. The invention of claim 1 wherein the means on the wall member includes an elevated ramp member extending away from the wall member.

3. The invention of claim 2 wherein the means for releasing the miniature vehicle includes a pivotal lever mounted on the wall member adjacent the ramp member.

4. The invention of claim 3 wherein the ramp member includes a serrated track member.

5. The invention of claim 3 wherein the wall member is pivotal from a horizontal position to launch a miniature vehicle to a vertical position to form a portion of a storage container.

6. The invention of claim 5 wherein a second wall member is movably connected to the base member and also includes means for restraining and means for releasing a miniature vehicle.

7. A combination storage container and launching apparatus for self propelled four-wheeled miniature vehicles comprising:

a base member having a support surface and a pair of end walls connected to the support surface;

a pair of side wall members pivotally connected to the base member, each side wall member having an integrally molded ramp member terminating in a retaining ledge, the dimension of the ramp member and retaining ledge being sufficient to support the front wheels of a miniature vehicle on the ramp member while restraining movement of the rear wheels against the retaining ledge, when pivoted to an operative horizontal position;

means on each side wall member for subjectively elevating the rear wheels to approximately the height of the ramp member whereby the self propelled miniature vehicle is released, the side wall members further capable of a pivotal movement to approximately a vertical position to form, with the base member, a storage container for at least one miniature vehicle.

8. The invention of claim 7 further including locking means on each side wall member to secure them in a vertical storage position.

9. The invention of claim 7 wherein the means for subjectively elevating the rear wheels includes a pivotal lever member.

10. The invention of claim 7 wherein handle means are provided on at least one side wall member.

11. The invention of claim 7 wherein each ramp member is partially serrated to improve traction of the rear wheels of the miniature vehicle.

12. The invention of claim 7 wherein each side wall member has a substantial L-shaped exterior configuration.

13. The invention of claim 12 wherein the end walls are interconnected by a central support member extending above the support surface.

14. A combination storage container and launching apparatus for self propelled miniature vehicles comprising:

a base member capable of supporting a miniature vehicle for storage;

at least one wall member movably connected to the base member from a first storage position to a second launching position;

means on the wall member for supporting and restraining a miniature vehicle, capable of self propulsion, in a stationary position, including an elevated ramp member extending away from the wall member, and means for releasing the miniature vehicle to permit propulsion of the vehicle, including a pivotal lever mounted on the wall member adjacent the ramp member.

15. The invention of claim 14 wherein the ramp member includes a serrated track member.

16. The invention of claim 14 wherein the wall member is pivotal from a horizontal position to launch a miniature vehicle to a vertical position to form a portion of a storage container.

17. The invention of claim 16 wherein a second wall member is movably connected to the base member and also includes means for restraining and means for releasing a miniature vehicle.

* * * * *